US012098894B1

(12) United States Patent
Viani

(10) Patent No.: US 12,098,894 B1
(45) Date of Patent: Sep. 24, 2024

(54) INVERTED LOCKING MECHANISMS

(71) Applicant: Arthur J. Viani, Miami, FL (US)

(72) Inventor: Arthur J. Viani, Miami, FL (US)

( * ) Notice: Subject to any disclaimer, the term of this patent is extended or adjusted under 35 U.S.C. 154(b) by 128 days.

(21) Appl. No.: 18/165,972

(22) Filed: Feb. 8, 2023

Related U.S. Application Data

(63) Continuation-in-part of application No. 17/536,675, filed on Nov. 29, 2021, now Pat. No. 11,662,165.

(51) Int. Cl.
*F41A 17/38* (2006.01)

(52) U.S. Cl.
CPC ..... *F41A 17/38* (2013.01)

(58) Field of Classification Search
CPC ..... F41A 9/65; F41A 9/01; F41A 9/61; F41A 9/63; F41A 9/64; F41A 9/66; F41A 9/67; F41A 9/71; F41A 9/59
USPC ..... 42/50
See application file for complete search history.

(56) References Cited

U.S. PATENT DOCUMENTS 3,453,762 A * 7/1969 Fremont ..... F41A 9/67 42/50
5,174,482 A * 12/1992 Rogers ..... F42B 39/02 224/679
5,526,600 A * 6/1996 Chesnut ..... F41A 9/65 42/50
7,117,622 B2 * 10/2006 Freed ..... F41A 9/65 42/71.02
10,094,636 B1 * 10/2018 Asbury ..... F41C 23/16
10,527,374 B1 * 1/2020 August ..... F41A 9/66
10,690,427 B1 * 6/2020 August ..... F41A 9/67
11,131,517 B2 * 9/2021 Coggins ..... F41A 9/71
2010/0281737 A1 * 11/2010 Cahill ..... F41A 9/70 42/50
2016/0370138 A1 * 12/2016 Zamm ..... F41A 9/66
2017/0138685 A1 * 5/2017 Beasley ..... F41A 9/71
2017/0146308 A1 * 5/2017 Plumb ..... F41A 9/65
2019/0154390 A1 * 5/2019 DiLeo ..... F41A 35/02
2020/0393209 A1 * 12/2020 Zhang ..... F41A 9/63
2021/0247156 A1 * 8/2021 Shreve ..... F41A 9/71

FOREIGN PATENT DOCUMENTS

WO WO-2020230135 A1 * 11/2020 ..... F16M 13/04

* cited by examiner

*Primary Examiner* — John Cooper
(74) *Attorney, Agent, or Firm* — ALBERT BORDAS P.A.

(57) ABSTRACT

An inverted locking mechanism, including a sleeve assembly, a base assembly and a magazine tube assembly. The sleeve assembly has sleeve front, rear and lateral walls, and first and second locking tab receiving holes. The base assembly includes base front, rear, lateral wall, bottom walls, and first and second slits defining first and second tongues with first and second locking tabs. In the first embodiment, locking tab receiving holes are disposed at the sleeve lateral walls. Slits and respective tongues with locking tabs are disposed at the base lateral walls. In the second embodiment, locking tab receiving holes are disposed at the sleeve front and rear walls. Slits, tongues and locking tabs are disposed at the base front and rear walls. The sleeve assembly cooperatively receive the base assembly therein, when an inwardly force of a predetermined magnitude is applied to the first and second locking tabs.

28 Claims, 10 Drawing Sheets

INVERTED LOCKING MECHANISMS

OTHER RELATED APPLICATIONS

The present application is a continuation-in-part of pending U.S. patent application Ser. No. 17/536,675, filed on Nov. 29, 2021, for Firearm Magazine Sleeve, which is hereby incorporated by reference.

BACKGROUND OF THE INVENTION

Field of the Invention

The present invention relates to firearms, and more particularly, to inverted locking mechanisms for firearm magazine sleeves.

Description of the Related Art

Applicant is not aware of any other prior art suggesting the novel features of the present invention, namely, an inverted locking mechanisms for firearm magazine sleeves.

SUMMARY OF THE INVENTION

The instant invention is an inverted locking mechanism comprising a sleeve assembly, a base assembly and a magazine tube assembly.

The sleeve assembly comprises a sleeve front wall, a sleeve rear wall and first and second sleeve lateral walls defining a substantially rectangular shape. The sleeve front wall, sleeve rear wall and first and second sleeve lateral walls comprise respective front bottom edge, rear bottom edge and first and second lateral bottom edges, defining a bottom perimeter edge. The sleeve assembly further comprises first and second locking tab receiving holes.

The base assembly comprises a base front wall, a base rear wall, first and second base lateral walls and a base bottom wall. The base front, rear wall and first and second lateral walls define a substantially rectangular shape with a first top perimeter edge. The base assembly further comprises first and second slits. First and second tongues are defined by the slits. The tongues have respective first and second tongue lower ends. First and second locking tabs extend outwardly from a portion adjacent to the first and second tongue lower ends. The first and second tongues are configured to provide a resilient movement of the first and second locking tabs. The first and second slits have respective first and second slit lower edges. The first and second locking tab receiving holes are aligned and disposed at a first predetermined distance from the bottom perimeter edge. The first and second slit lower edges are aligned and at a second predetermined distance from the base bottom wall. The first predetermined distance and the second predetermined distance are substantially the same.

The magazine tube assembly comprises first and second sidewalls, a magazine forward face, magazine aft face, a magazine lip having a magazine base edge, and first and second magazine tabs.

The sleeve assembly has cooperative shape and dimensions to receive the base assembly therein, when an inwardly force of predetermined magnitude is applied to the first and second locking tabs.

The magazine tube assembly receives a magazine spring, the lower portion of the magazine spring is inserted inside the inverted locking mechanism.

In a first embodiment of the inverted locking mechanism, the first and second locking tab receiving holes are aligned and disposed at the first and second sleeve lateral walls. The first and second slits and respective the first and second tongues with the first and second locking tabs are disposed at the first and second base lateral walls. The sleeve assembly further comprises a lip at the top of the sleeve front wall, the sleeve rear wall and the first and second sleeve lateral walls. The sleeve assembly further comprises a front top wall, a rear top wall and first and second lateral top walls extending inside the lip, and extending a third predetermine distance below the lip and a fourth predetermined distance above the lip. The front top wall, the rear top wall and the first and second lateral top walls comprise a front top edge, a rear top edge and first and second lateral top edges, respectively. The front top edge, the rear top edge and the lateral top edges define a second top perimeter edge. The front top wall, the rear top wall and the first and second lateral top walls further define a lower perimeter edge. The lower perimeter edge has first and second indents extending therefrom at the first and second lateral top walls, respectively. The sleeve rear wall is higher than the sleeve front wall. The first and second lateral top walls are at an angle with respect to first and second lateral bottom edges. The second top perimeter edge and the lower perimeter edge are at the same angle. The first and second magazine tabs have cooperative dimensions and shape to fit into the first and second indents of the sleeve assembly, when the inverted locking mechanism is assembled.

In a second embodiment of the inverted locking mechanism, the first and second locking tab receiving holes are aligned and disposed at the sleeve front wall and the sleeve rear wall. The first and second slits and respective the first and second tongues with the first and second locking tabs are disposed at the base front wall and the base rear wall. The sleeve front wall, the sleeve rear wall and the first and second sleeve lateral walls have a front top edge, a rear top edge and first and second lateral top edges, respectively, defining a second top perimeter edge. The sleeve front wall and the sleeve rear wall are disposed at a first angle with respect to the vertical axle. The sleeve assembly further comprises an inward ridge, which extends a predetermine distance from the top perimeter edge inside the sleeve assembly. The inward ridge comprises a lower perimeter edge and first and second indents at the at sleeve lateral walls. The first and second indents extend from the top perimeter edge to the lower perimeter edge. The base front wall and base rear wall are disposed at the first angle with respect to the vertical axle. The sleeve assembly further comprises a semicircular tab that extends upwardly from the sleeve front wall at a second angle with the latest. The first and second magazine tabs have cooperative dimensions and shape to fit into the first and second indents of the sleeve assembly, when the inverted locking mechanism is assembled. The base assembly further comprises first and second steps extending from the top perimeter edge to the base bottom wall. The base bottom wall comprises first and second semicircular protrusions, the lower portion of the magazine spring rests on the base bottom wall and is kept in place by the first and second semicircular protrusions.

Both embodiments of the inverted locking mechanism are configured to be assembled by inserting the sleeve assembly around the magazine tube assembly from top to bottom, until it is stopped when the lower perimeter edge with the indents reach the magazine lip with the magazine tabs, respectively, then, the base assembly is inserted inside the sleeve assembly from the bottom while user applies the inwardly force of predetermined magnitude to the first and second locking tabs, until the locking tabs reach and are resiliently released through the locking tab receiving holes, securely locking the base assembly inside sleeve assembly.

Each base bottom wall of the first and second embodiments comprise first and second holes. The holes configured to let any dirt inside the inverted locking mechanism out.

It is therefore one of the main objects of the present invention to provide an inverted locking mechanism for different types of magazines.

It is another object of this invention to provide an inverted locking mechanism that do not conflict during assembly with the magazine spring.

It is another object of this invention to provide an inverted locking mechanism including a flush base bottom wall, making a more secure mechanism since it's more difficult for users to separate from the sleeve, preventing accidental disassembly.

It is another object of this invention to provide an inverted locking mechanism, which mounts onto a magazine tube assembly and locks it.

It is another object of this invention to provide an inverted locking mechanism having a sleeve assembly and a base assembly.

It is another object of this invention to provide an inverted locking mechanism, which sleeve assembly receive respective magazine base.

It is another object of this invention to provide an inverted locking mechanism that is volumetrically efficient for carrying, transporting, and storage.

It is another object of this invention to provide an inverted locking mechanism that can be readily assembled and disassembled without the need of any special tools.

It is yet another object of this invention to provide such a device that is of a durable, reliable construction, inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
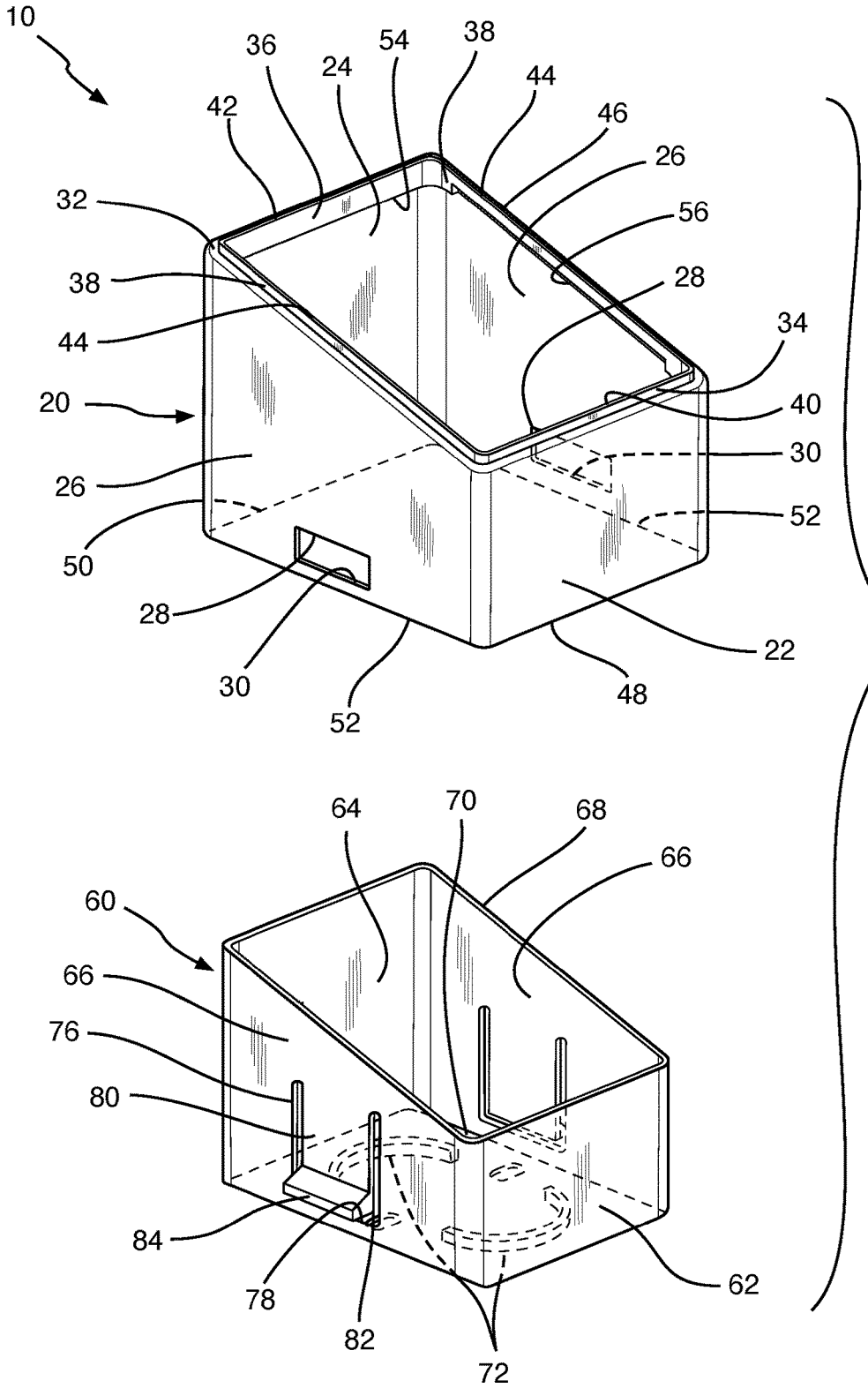
FIG. 1 represents a front isometric view of a preferred embodiment for an inverted locking mechanism.

Referring now to the drawings, the present invention includes embodiments adapted to be assembled with two basic different types of magazines. These embodiments can be adapted to other magazines with minimal modifications.

The preferred embodiment for the present invention is generally referred to with numeral 10. It can be observed that it basically includes sleeve assembly 20, base assembly 60 and magazine straight tube assembly 100.

Figure 2:
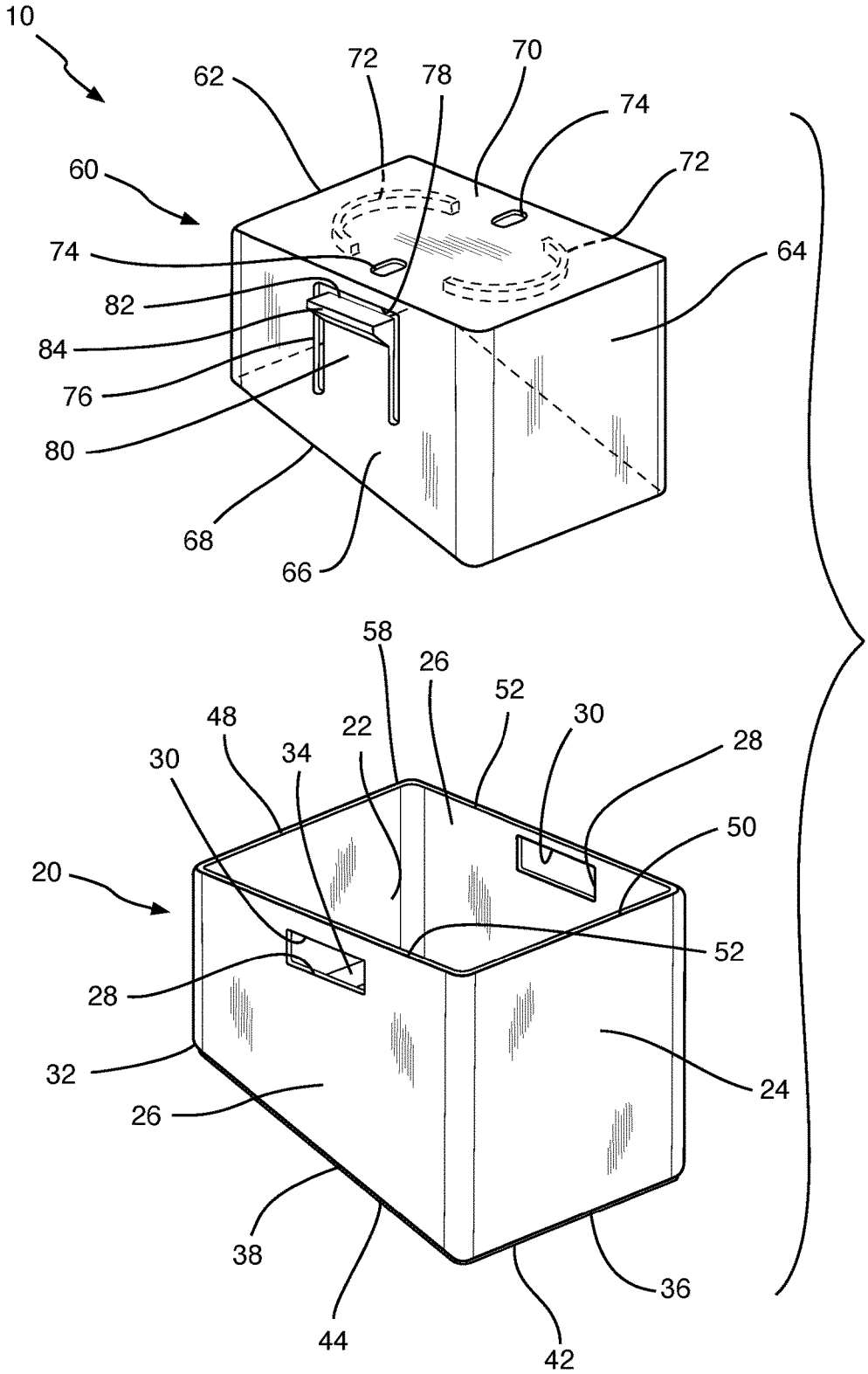
FIG. 2 is a rear isometric view of the preferred embodiment shown in FIG. 1 for the inverted locking mechanism shown in FIG. 1, showing the invention upside down.

As seen in FIGS. 1 and 2, sleeve assembly 20 comprises sleeve front wall 22, sleeve rear wall 24 and sleeve lateral walls 26, defining a substantially rectangular shape with lip 32 at the top. Front top wall 34, rear top wall 36 and lateral top walls 38 extend inside lip 32 at a predetermine distance below lip 32 and a predetermined distance above lip 32. Front top wall 34, rear top wall 36 and lateral top walls 38 have respective front top edge 40, rear top edge 42 and lateral top edges 44, which define top perimeter edge 46. Also, front top wall 34, rear top wall 36 and lateral top walls 38 have lower perimeter edge 54 with indents 56 extending therefrom at lateral top walls 38. Sleeve front wall 22, sleeve rear wall 24 and sleeve lateral walls 26 further include respective front bottom edge 48, rear bottom edge 50 and lateral bottom edges 52 defining bottom perimeter edge 58. It is noticed that sleeve rear wall 24 is higher than sleeve front wall 22, making lateral top edges 44 being at an angle with respect to lateral bottom edges 52. The angle with respect to lateral bottom edges 52 is in a range of 8-18 degrees. Sleeve lateral walls 26 have locking tab receiving holes 28 with locking tab receiving holes lower edges 30. Locking tab receiving holes and lower edges 30 are aligned and at a predetermined distance above lateral bottom edges 52.

Base assembly 60 comprises base front wall 62, base rear wall 64, base lateral walls 66 and bottom wall 70 (best seen in FIG. 2). Base front wall 62, base rear wall 64, base lateral walls 66 define a substantially rectangular shape with top perimeter edge 68. Top perimeter edge 68 having the same angle than lower perimeter edge 54. Bottom wall 70 has semicircular protrusions 72 extending upwardly and holes 74. Holes 74 are provided for any dirt inside inverted locking mechanism inverted locking mechanism 10 to escape. Base lateral walls 66 comprise slits 76 having slit lower edges 78. Slits 76 define tongues 80. Tongues 80 have tongue lower ends 82. Locking tabs 84 extend outwardly from a portion adjacent to tongue lower ends 82. Slit lower edges 78 are aligned and at a predetermined distance from bottom wall 70. The configuration of tongues 80 provide a resilient movement of locking tabs 84 to be flat with respect to base lateral walls 66 when an inwardly force of a predetermined magnitude is applied.

Figure 3A:
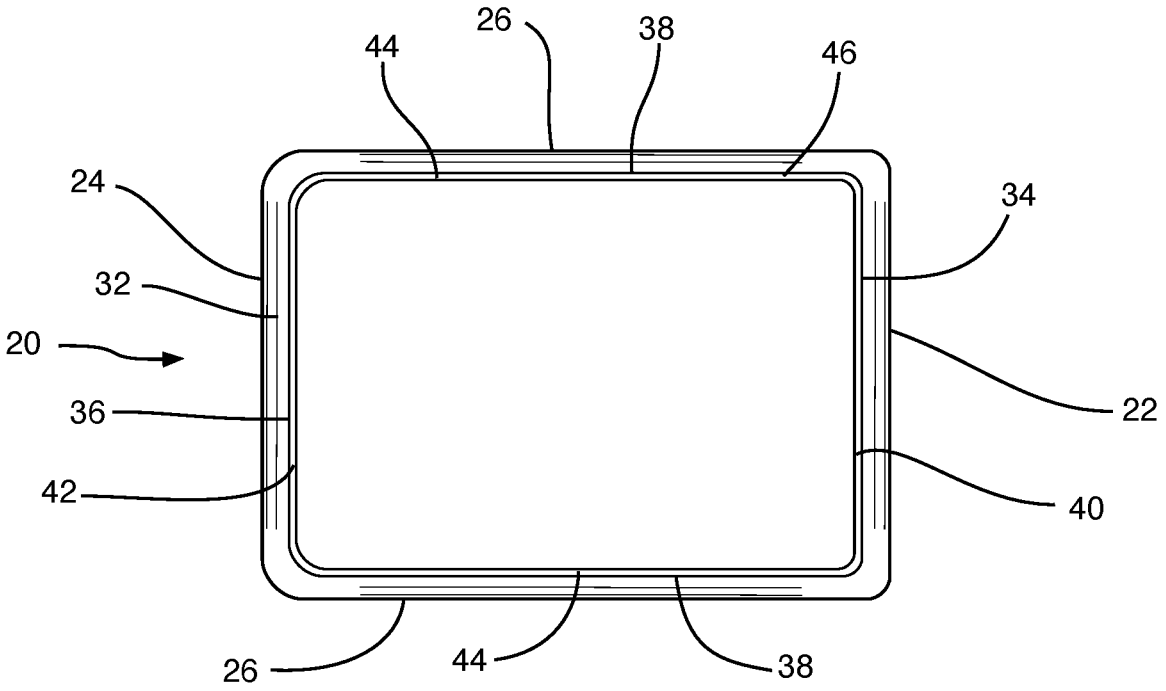
FIG. 3A is a top view of the sleeve assembly for the preferred embodiment shown in FIG. 1.
Figure 3B:
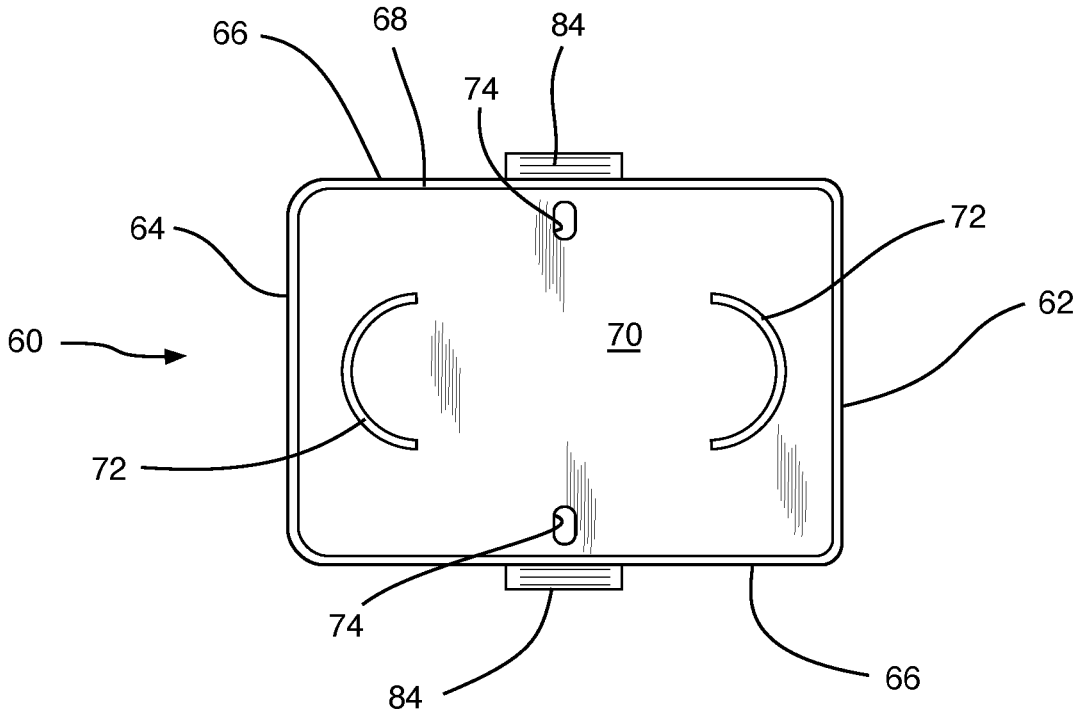
FIG. 3B is a top view of the base assembly for the preferred embodiment shown in FIG. 1.

As seen in FIGS. 3A and 3B, sleeve assembly 20 has cooperative shape and dimensions to receive base assembly 60 therein, when the inwardly force of predetermined magnitude is applied to locking tabs 84.

Figure 4:
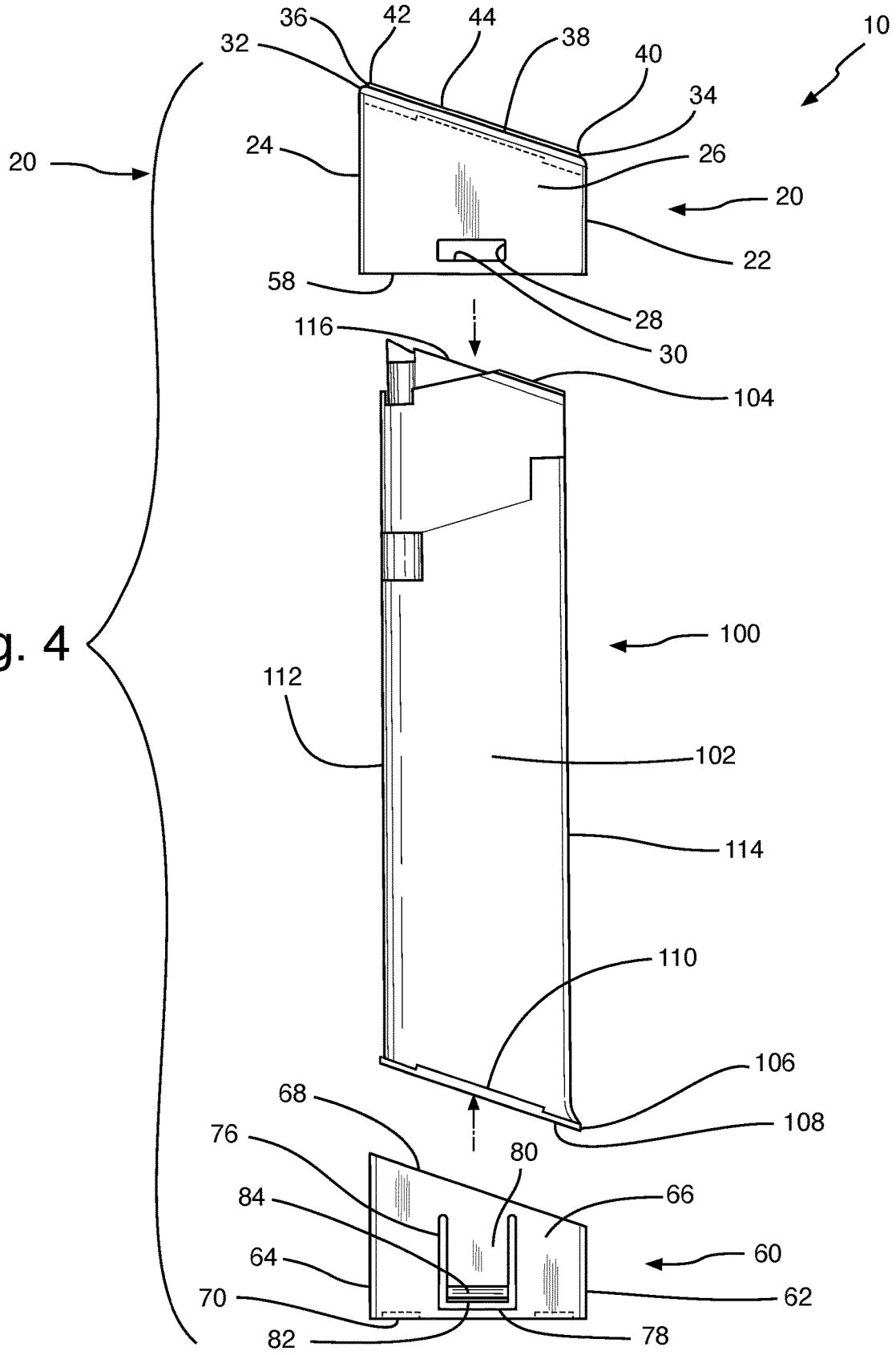
FIG. 4 is a side view of a disassembled magazine assembly including the preferred embodiment for the inverted locking mechanism.

As seen in FIG. 4, straight magazine tube assembly 100 comprises sidewalls 102, magazine forward face 112 and magazine aft face 114. Straight magazine tube assembly 100 further comprises magazine top edge 104, follower 116, magazine lip 106, magazine base edge 108 and magazine tabs 110. Magazine base edge 108 defines the same angle than lower perimeter edge 54 and magazine tabs 110 have cooperative dimension and shape to fit in indents 56 of sleeve assembly 20, when inverted locking mechanism 10 is assembled, as shown in FIG. 5.

Figure 5:
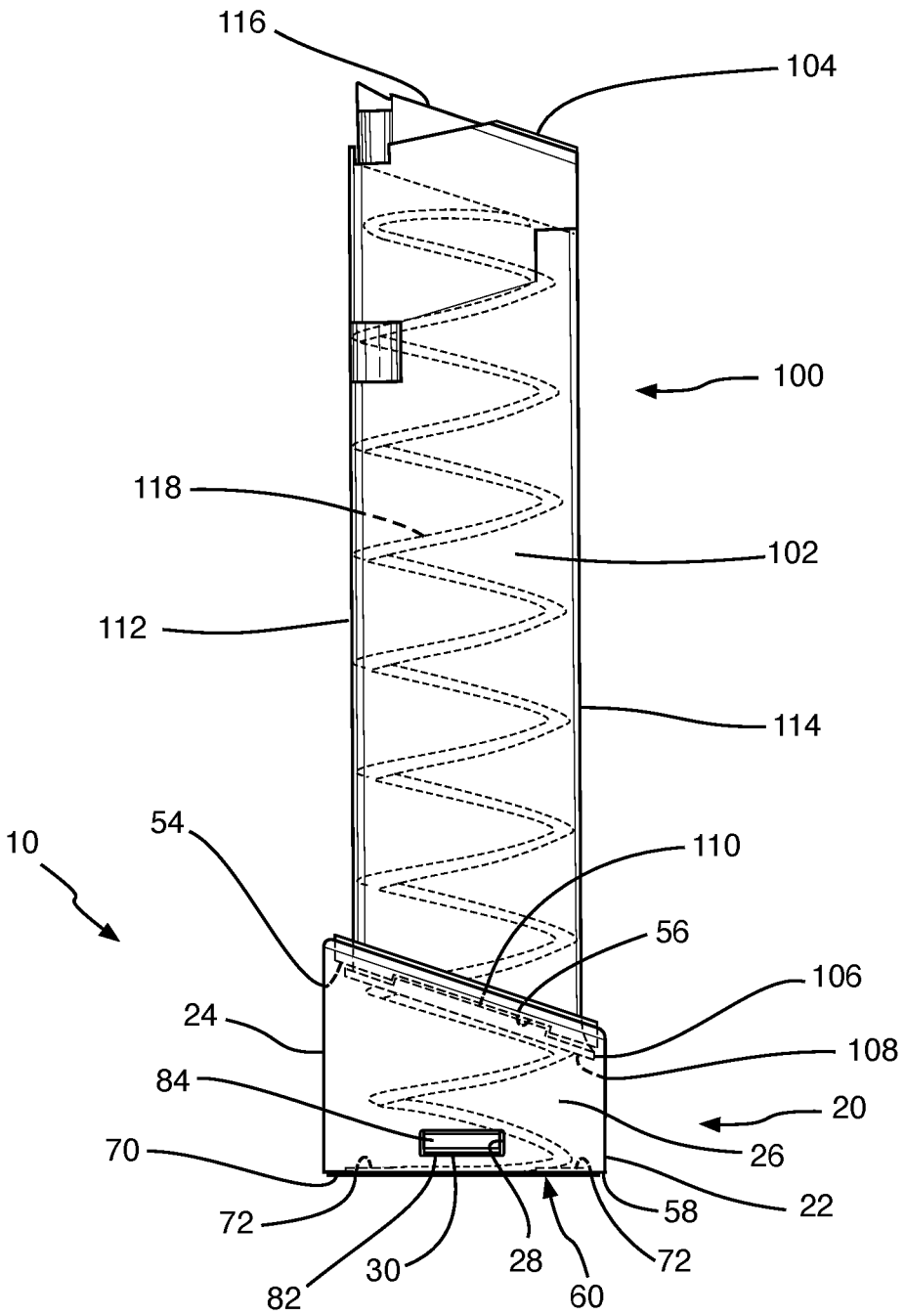
FIG. 5 is a side view of an assembled magazine assembly including the preferred embodiment for the inverted locking mechanism shown in the previous figures.

As seen in FIG. 5, to assemble inverted locking mechanism 10, sleeve assembly 20 is inserted around straight magazine tube assembly 100 from top to bottom, until it is stopped when lower perimeter edge 54 with indents 56 reach magazine lip 106 with magazine tabs 110, respectively. Then, base assembly 60 is inserted inside sleeve assembly 20 from the bottom while user applies an inwardly force of predetermined magnitude to locking tabs 84, until locking tabs 84 reach and are resiliently released through locking tab receiving holes 28, securely locking base assembly 60 inside sleeve assembly 20. Bottom wall 70 is substantially aligned with bottom perimeter edge 58, which provides assembled inverted locking mechanism 10 a more secure mechanism and making more difficult to separate base assembly 60 from sleeve assembly 20, preventing accidental disassembly. Once inverted locking mechanism 10 is assembled, it receives magazine spring 118 therein. The lower portion of magazine spring 118 rests on bottom wall 70 of base assembly 60 and it is kept in place by semicircular protrusions 72.

As seen in FIGS. 6 to 10, an alternate embodiment for the present invention is referred to with numeral 200. It can be observed that it basically includes sleeve assembly 220, base assembly 260 and angled magazine tube assembly 320.

Figure 6:
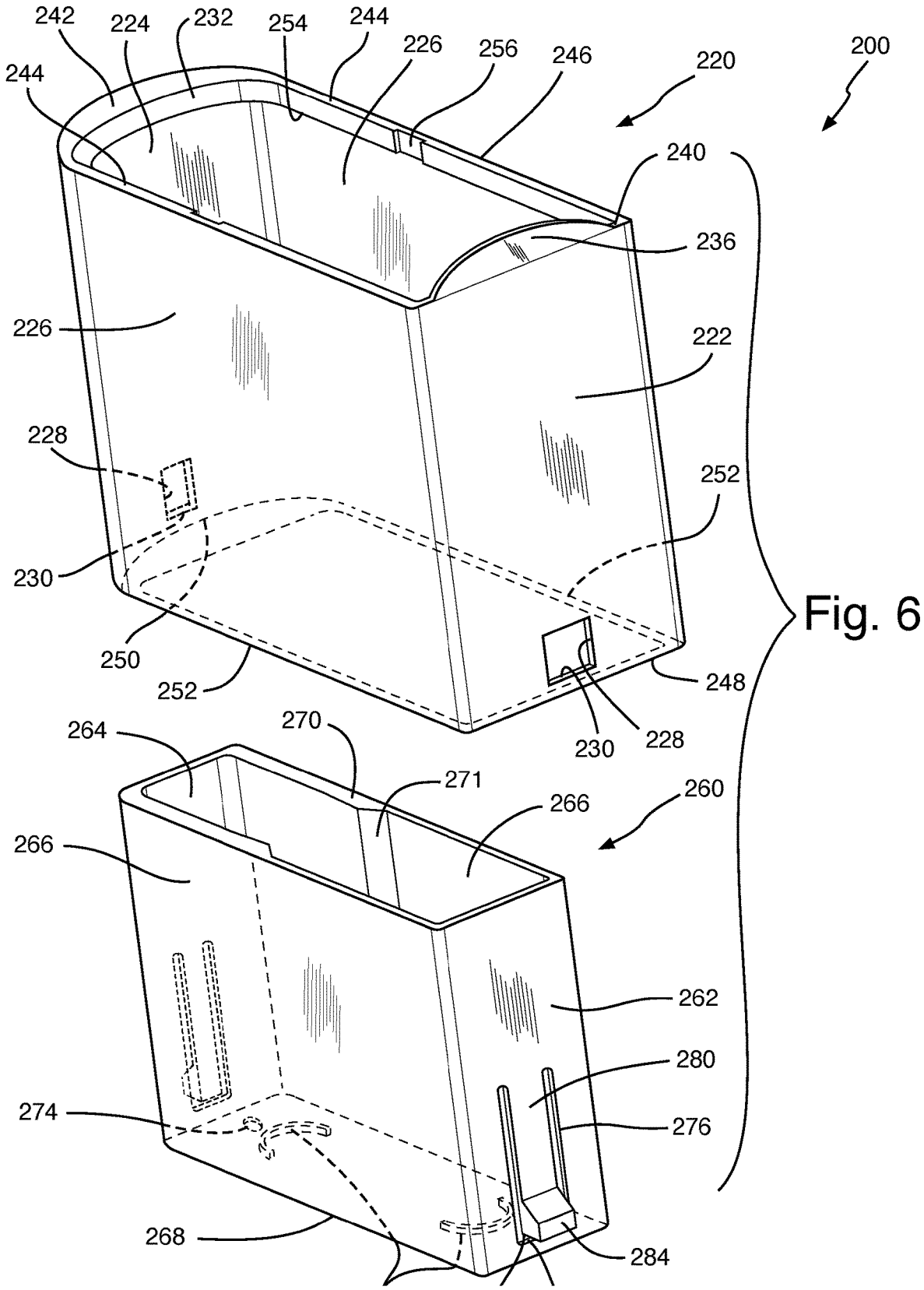
FIG. 6 represents an isometric view of an alternate embodiment for inverted locking mechanism.
Figure 7:
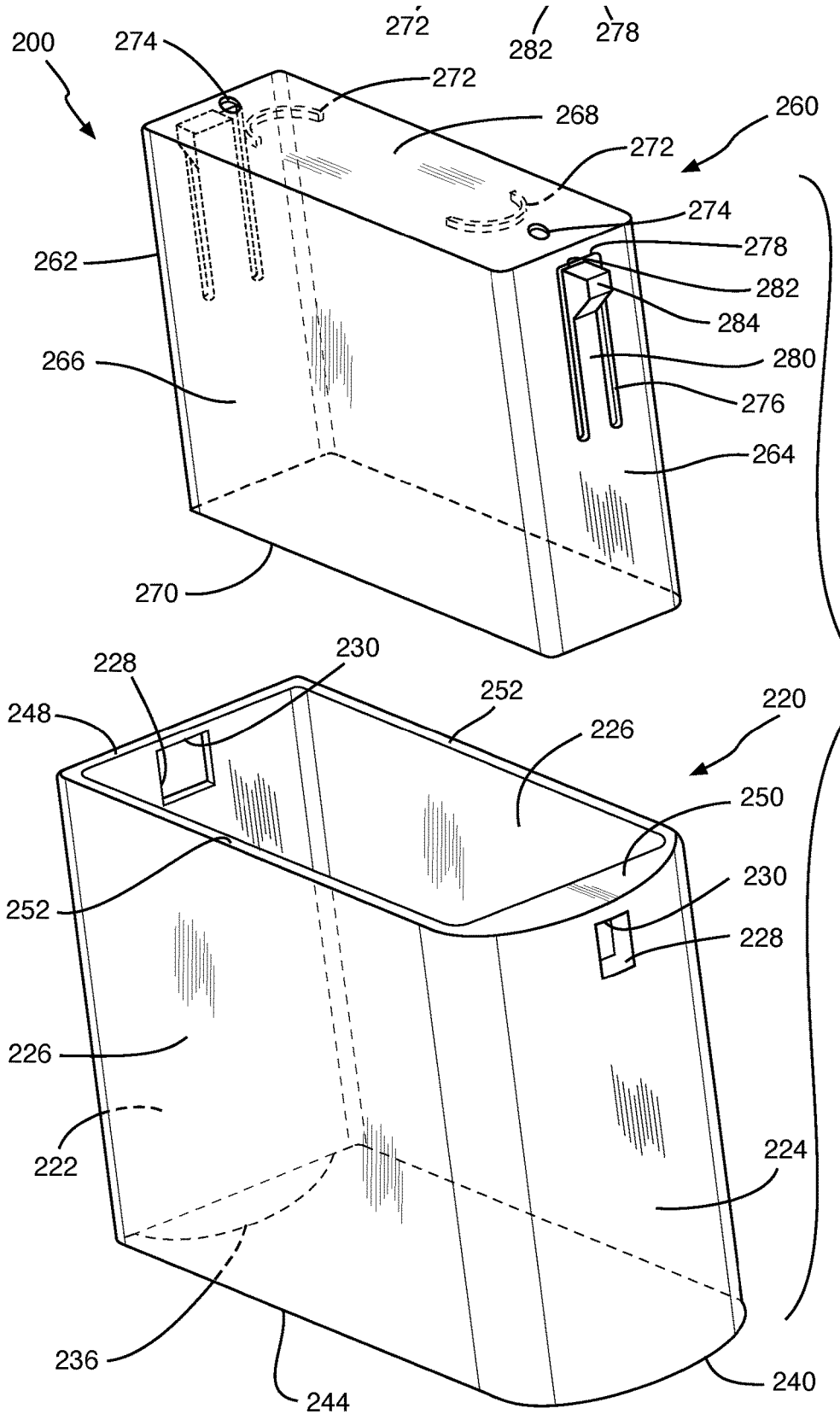
FIG. 7 is a rear isometric view of the alternate embodiment shown in FIG. 6 for the inverted locking mechanism, showing the invention upside down.

As seen in FIGS. 6 and 7, sleeve assembly 220 comprises sleeve front wall 222, sleeve rear wall 224 and sleeve lateral walls 226, defining a substantially rectangular shape. Sleeve front wall 222, sleeve rear wall 224 and sleeve lateral walls 226 have respective front top edge 240, rear top edge 242 and lateral top edges 244. Front top edge 240, rear top edge 242 and lateral top edges 244 define top perimeter edge 246. Sleeve front wall 222, sleeve rear wall 224 and sleeve lateral walls 226 further have respective front bottom edge 248, rear bottom edge 250 and lateral bottom edges 252. Front bottom edge 248, rear bottom edge 250 and lateral bottom edges 252 define bottom perimeter edge 258. Semicircular tab 236 extends upwardly from sleeve front wall 222 at a first angle with the latest. Sleeve front wall 222 and sleeve rear wall 224 are not perpendicular with respect to top perimeter edge 246 and bottom perimeter edge 258, they are disposed at a second angle with respect to the vertical axle. The second angle with respect to the vertical axle is in a range of 8-14 degrees. Inward ridge 232 extends inside sleeve front wall 222, sleeve rear wall 224 and sleeve lateral walls 226, at a predetermine distance below top perimeter edge 246. Inward ridge 232 has lower perimeter edge 254. Indents 256 extend from top perimeter edge 246 to lower perimeter edge 254 at sleeve lateral walls 226. Each of sleeve front wall 222 and sleeve rear wall 224 has a locking tab receiving hole 228 with locking tab receiving holes lower edges 230. Locking tab receiving holes 228 and lower edges 230 are aligned and at a predetermined distance from front bottom edge 248, rear bottom edge 250. It is noticed that the outer face of sleeve rear wall 224 is substantially semicircular while its interior face is substantially flat. Accordingly, locking tab receiving hole 228 disposed at sleeve rear wall 224 is narrower than locking tab receiving hole 228 disposed at sleeve front wall 222 (best seen in FIG. 7).

Base assembly 260 comprises base front wall 262, base rear wall 264, base lateral walls 266 and base bottom wall 268 (best seen in FIG. 7). Base front wall 262, base rear wall 264, base lateral walls 266 define a substantially rectangular shape with top perimeter edge 270. Base front wall 262 and base rear wall 264 are not perpendicular with respect to top perimeter edge 246 and base bottom wall 268, they are disposed at a third angle with respect to the vertical axle, the third angle is the same that the second angle of the sleeve front wall 222 and sleeve rear wall 224 with respect to the vertical axle. Base lateral walls 266 have step 271. Step 271 help magazine spring 338 and bullets (not shown) to snap into place.

Bottom wall 268 has semicircular protrusions 272 extending upwardly and holes 274. Holes 274 are provided for any dirt inside inverted locking mechanism 200 to escape. Base front wall 262 and base rear wall 264 comprise slits 276 having slit lower edges 278. Slits 276 define tongues 280. Tongues 280 have tongue lower ends 282. Locking tabs 284 extend outwardly from a portion adjacent to tongue lower ends 282. Slit lower edges 278 are aligned and at a predetermined distance from bottom wall 268. The configuration of tongues 280 provide a resilient movement of locking tabs 284 to be flat with respect to base front wall 262 and base rear wall 264 when an inwardly force of a predetermined magnitude is applied.

Figure 8A:
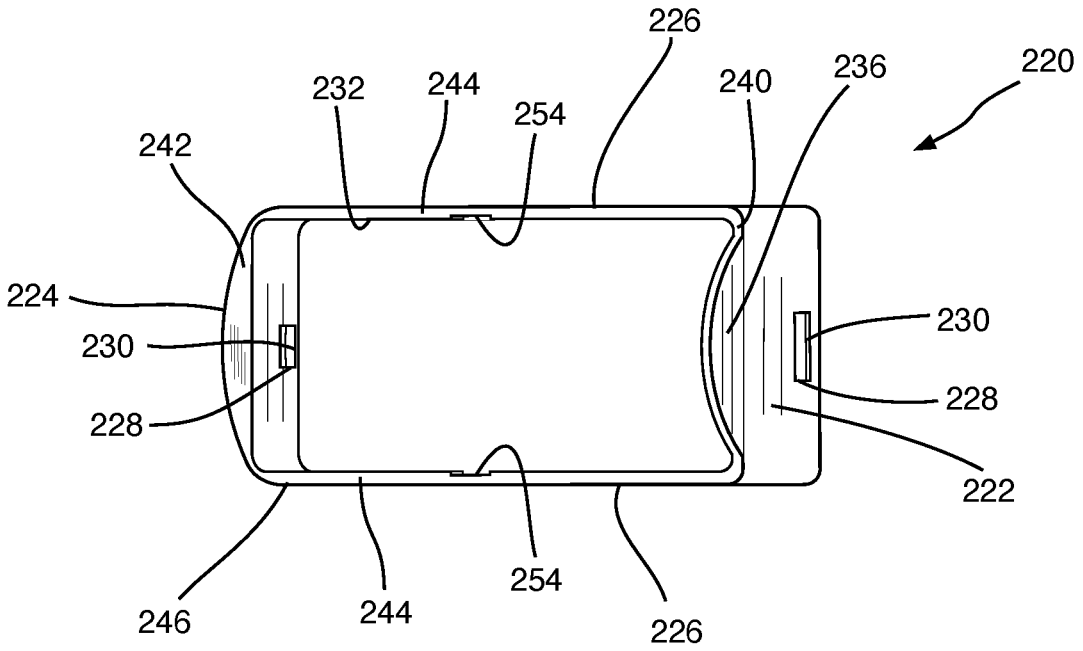
FIG. 8A is a top view of the sleeve assembly for the alternate embodiment shown in FIG. 6.
Figure 8B:
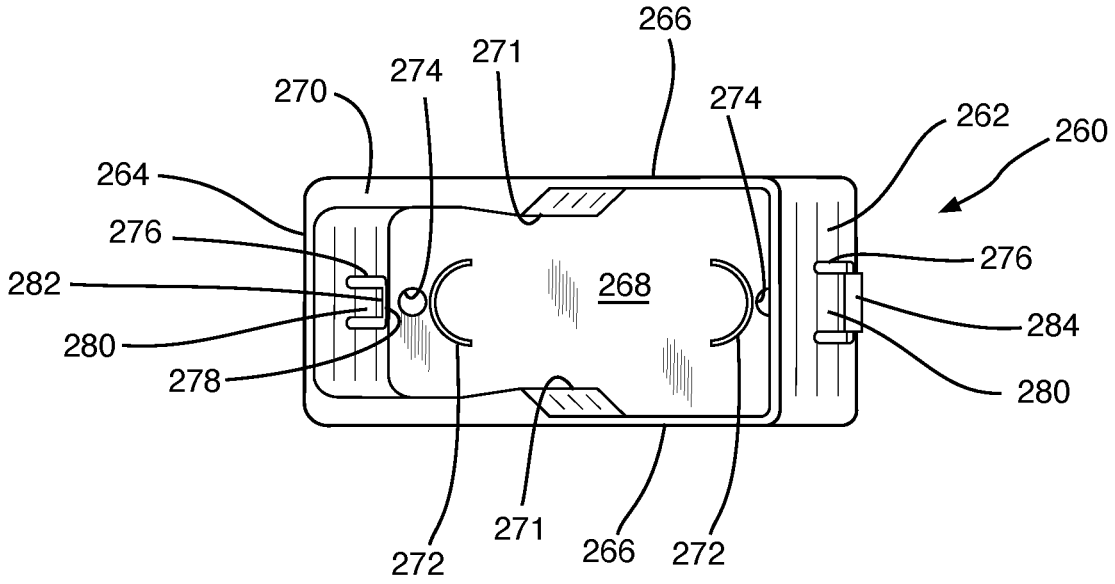
FIG. 8B is a top view of the base assembly for the alternate embodiment shown in FIG. 6.

As seen in FIGS. 8A and 8B, sleeve assembly 220 has cooperative shape and dimensions to receive base assembly 260 therein, when an inwardly force of predetermined magnitude is applied to locking tabs 284. Steps 271 extend from top perimeter edge 270 to base bottom wall 268 at the same third angle with respect to the vertical axle.

Figure 9:
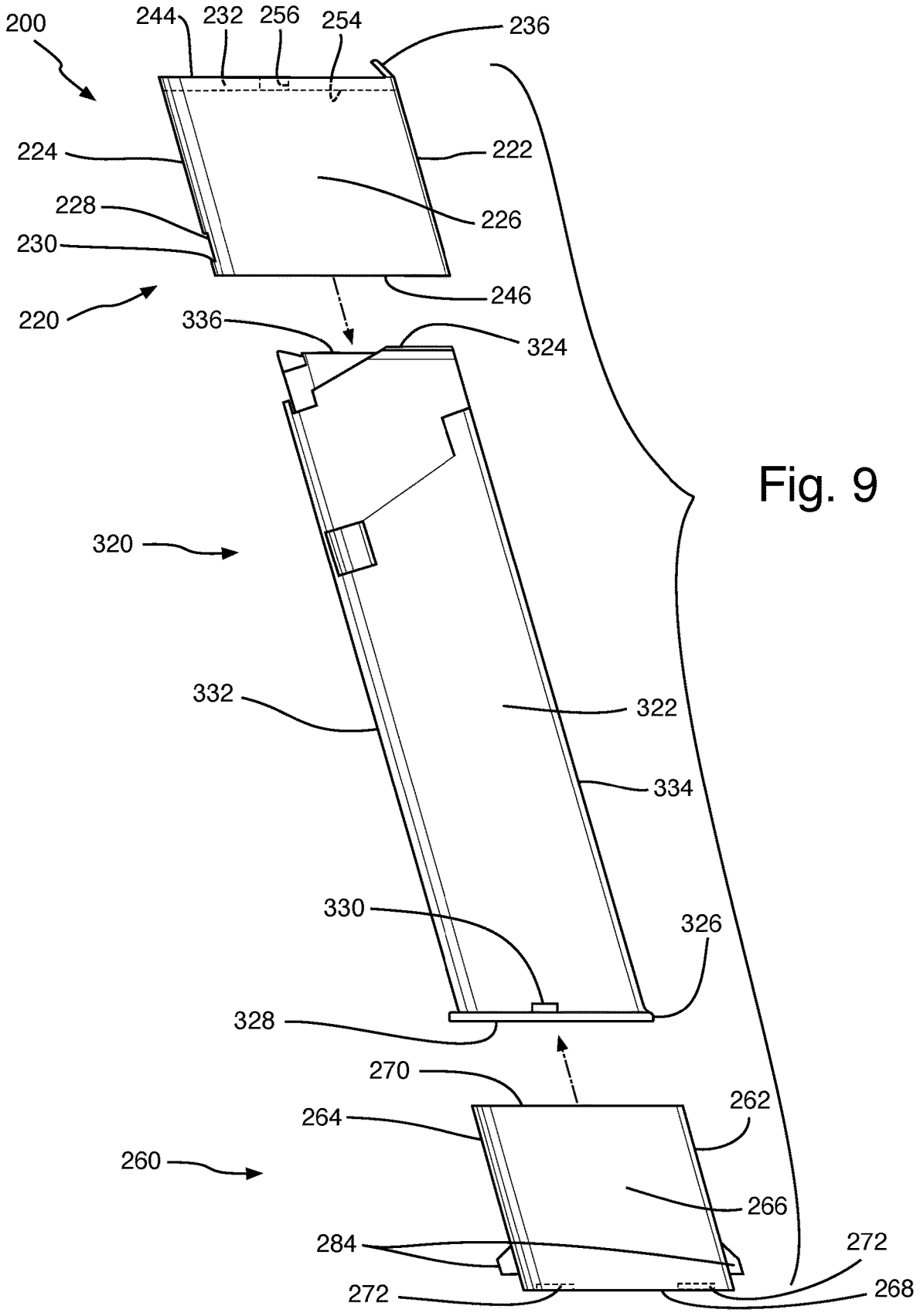
FIG. 9 is a side view of a disassembled magazine assembly including the alternate embodiment shown in FIG. 6 for the inverted locking mechanism.

As seen in FIG. 9, angled magazine tube assembly 320 comprises sidewalls 322, magazine forward face 332 and magazine aft face 334. Angled magazine tube assembly 320 further comprises magazine top edge 324, follower 336, magazine lip 326, magazine base edge 328 and magazine tabs 330. Magazine forward face 332 and magazine aft face 334 are at the same second and third angle with respect to the vertical axle. Magazine tabs 330 have cooperative dimensions and shape to fit into indents 256 of sleeve assembly 220, when inverted locking mechanism 200 is assembled, as shown in FIG. 10.

Figure 10:
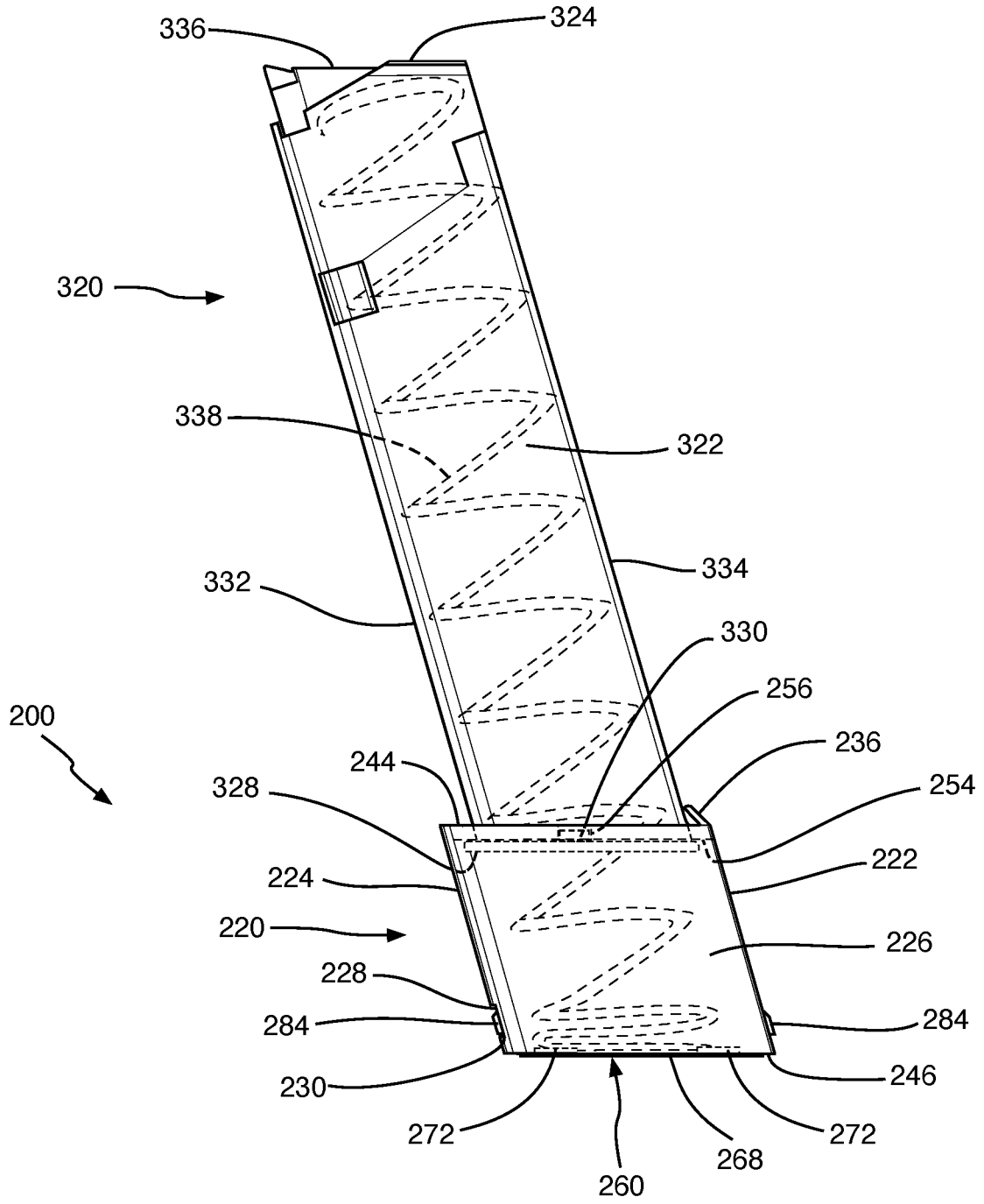
FIG. 10 is a side view of an assembled magazine assembly including the alternate embodiment for the inverted locking mechanism shown in FIG. 6.

As seen in FIG. 10, to assemble inverted locking mechanism 200, sleeve assembly 220 is inserted around angled magazine tube assembly 320 from top to bottom, until it is stopped when lower perimeter edge 254 with indents 256 reach magazine lip 326 with magazine tabs 330, respectively. Then, base assembly 260 is inserted inside sleeve assembly 220 from the bottom while user applies an inwardly force of predetermined magnitude to locking tabs 284, until locking tabs 284 reach and are resiliently released through locking tab receiving holes 228 securely locking base assembly 260 inside sleeve assembly 220. Bottom wall 268 is substantially aligned with bottom perimeter edge 246, which provides assembled inverted locking mechanism 200 a more secure mechanism and making more difficult to separate base assembly 260 from sleeve assembly 220, preventing accidental disassembly. Semicircular tab 236 contacts magazine aft face 334 to keep it aligned when sleeve assembly 220 is being inserted onto angled magazine tube assembly 320.

Once inverted locking mechanism 200 is assembled, it receives magazine spring 338 therein. The lower portion of magazine spring 338 rests on bottom wall 268 of base assembly 260 and it is kept in place by semicircular protrusions 272.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An inverted locking mechanism, comprising:

A) a sleeve assembly comprising a sleeve front wall, a sleeve rear wall and first and second sleeve lateral walls defining a substantially rectangular shape, said sleeve front wall, said sleeve rear wall and said first and second sleeve lateral walls comprising a front bottom edge, a rear bottom edge and first and second lateral bottom edges, respectively, defining a bottom perimeter edge, said sleeve assembly further comprises first and second locking tab receiving holes;

B) a base assembly comprising a base front wall, a base rear wall, first and second base lateral walls and a base bottom wall, said base front wall, said base rear wall and said first and second base lateral walls defining a substantially rectangular shape with a first top perimeter edge, said base assembly further comprising first and second slits, first and second tongues are defined by said slits, said tongues having respective first and second tongue lower ends, first and second locking tabs extend outwardly from a portion adjacent to said first and second tongue lower ends; and C) a magazine tube assembly comprising first and second sidewalls, a magazine forward face, magazine aft face, a magazine lip having a magazine base edge and first and second magazine tabs.

2. The inverted locking mechanism set forth in claim 1, wherein said first and second tongues are configured to provide a resilient movement of said first and second locking tabs.

3. The inverted locking mechanism set forth in claim 2, whereby said sleeve assembly has cooperative shape and dimension to receive said base assembly therein when an inwardly force of predetermined magnitude is applied to said first and second locking tabs.

4. The inverted locking mechanism set forth in claim 3, wherein said first and second slits have respective first and second slit lower edges, said first and second locking tab receiving holes are aligned and disposed at a first predetermined distance from said bottom perimeter edge and said first and second slit lower edges are aligned and at a second predetermined distance from said base bottom wall, said first predetermined distance and said second predetermined distance are substantially the same.

5. The inverted locking mechanism set forth in claim 4, wherein said magazine tube assembly receives a magazine spring, the lower portion of said magazine spring is inserted inside said inverted locking mechanism.

6. The inverted locking mechanism set forth in claim 5, wherein said first and second locking tab receiving holes are aligned and disposed at said first and second sleeve lateral walls.

7. The inverted locking mechanism set forth in claim 6, wherein said first and second slits and respective said first and second tongues with said first and second locking tabs are disposed at said first and second base lateral walls.

8. The inverted locking mechanism set forth in claim 7, wherein said sleeve assembly further comprises a lip at the top of said sleeve front wall, said sleeve rear wall and said first and second sleeve lateral walls.

9. The inverted locking mechanism set forth in claim 8, wherein said sleeve assembly further comprises a front top wall, a rear top wall and first and second lateral top walls extending inside said lip, and extending a third predetermine distance below said lip and a fourth predetermined distance above said lip.

10. The inverted locking mechanism set forth in claim 9, wherein said front top wall, said rear top wall and said first and second lateral top walls comprise a front top edge, a rear top edge and first and second lateral top edges, respectively, said front top edge, said rear top edge and said lateral top edges define a second top perimeter edge.

11. The inverted locking mechanism set forth in claim 10, wherein said front top wall, said rear top wall and said first and second lateral top walls further define a lower perimeter edge, said lower perimeter edge has first and second indents extending therefrom at said first and second lateral top walls, respectively.

12. The inverted locking mechanism set forth in claim 11, wherein said sleeve rear wall is higher than said sleeve front wall, said first and second lateral top walls being at an angle with respect to first and second lateral bottom edges.

13. The inverted locking mechanism set forth in claim 12, whereby said second top perimeter edge and said lower perimeter edge are at said angle.

14. The inverted locking mechanism set forth in claim 13, wherein said first and second magazine tabs have cooperative dimensions and shape to fit into said first and second indents of said sleeve assembly, when said inverted locking mechanism is assembled.

15. The inverted locking mechanism set forth in claim 14, configured to be assembled by inserting said sleeve assembly around said magazine tube assembly from top to bottom, until it is stopped when said lower perimeter edge with said indents reach said magazine lip with said magazine tabs, respectively, then, said base assembly is inserted inside said sleeve assembly from the bottom while user applies said inwardly force of predetermined magnitude to said first and second locking tabs, until said locking tabs reach and are resiliently released through said locking tab receiving holes, securely locking said base assembly inside sleeve assembly.

16. The inverted locking mechanism set forth in claim 5, wherein said first and second locking tab receiving holes are aligned and disposed at said sleeve front wall and said sleeve rear wall.

17. The inverted locking mechanism set forth in claim 16, wherein said first and second slits and respective said first and second tongues with said first and second locking tabs are disposed at said base front wall and said base rear wall.

18. The inverted locking mechanism set forth in claim 17, wherein said sleeve front wall, said sleeve rear wall and said first and second sleeve lateral walls have a front top edge, a rear top edge and first and second lateral top edges, respectively, defining a second top perimeter edge.

19. The inverted locking mechanism set forth in claim 18, wherein said sleeve front wall and said sleeve rear wall are disposed at a first angle with respect to the vertical axle.

20. The inverted locking mechanism set forth in claim 19, wherein said sleeve assembly further comprises an inward ridge, said inward ridge extends a predetermine distance from said top perimeter edge inside said sleeve assembly, said inward ridge comprises a lower perimeter edge.

21. The inverted locking mechanism set forth in claim 20, wherein said inward ridge further comprises first and second indents at said at sleeve lateral walls, said first and second indents extend from said top perimeter edge to said lower perimeter edge.

22. The inverted locking mechanism set forth in claim 21, wherein said base front wall and said base rear wall are disposed at said first angle with respect to the vertical axle.

23. The inverted locking mechanism set forth in claim 22, wherein said sleeve assembly further comprises a semicircular tab that extends upwardly from said sleeve front wall at a second angle with the latest.

24. The inverted locking mechanism set forth in claim 23, wherein said first and second magazine tabs have cooperative dimensions and shape to fit into said first and second indents of said sleeve assembly, when said inverted locking mechanism is assembled.

25. The inverted locking mechanism set forth in claim 24, wherein said base assembly further comprises first and second steps extending from said top perimeter edge to said base bottom wall.

26. The inverted locking mechanism set forth in claim 25, wherein said base bottom wall comprises first and second semicircular protrusions, a lower portion of said magazine spring rests on said base bottom wall and is kept in place by said first and second semicircular protrusions.

27. The inverted locking mechanism set forth in claim 26, configured to be assembled by inserting said sleeve assembly around said magazine tube assembly from top to bottom, until it is stopped when said lower perimeter edge with said indents reach said magazine lip with said magazine tabs, respectively, then, said base assembly is inserted inside said sleeve assembly from the bottom while user applies said inwardly force of predetermined magnitude to said first and second locking tabs, until said locking tabs reach and are resiliently released through said locking tab receiving holes, securely locking said base assembly inside sleeve assembly.

28. The inverted locking mechanism set forth in claim 5, wherein said base bottom wall comprises first and second holes, said holes configured to let any dirt inside said inverted locking mechanism out.

* * * * *